US005482240A

United States Patent [19]

Caraher

[11] Patent Number: 5,482,240

[45] Date of Patent: Jan. 9, 1996

[54] ADJUSTABLE HANGER FOR SUSPENDED CEILINGS

[76] Inventor: Thomas R. Caraher, 22235 River Ridge Trail, Farmington Hills, Mich. 48335

[21] Appl. No.: 113,053

[22] Filed: Aug. 25, 1993

[51] Int. Cl.[6] ..... E04C 1/40

[52] U.S. Cl. ..... 248/297.51; 52/506.06; 248/300; 248/317; 248/327

[58] Field of Search ..... 248/327, 343, 248/317, 300, 297.5; 52/506.06, 506.07, 664, 665

[56] References Cited

U.S. PATENT DOCUMENTS

| | | | |
|---|---|---|---|
| 3,911,638 | 10/1975 | Englund et al. . | |
| 3,995,823 | 12/1976 | Hensel . | |
| 4,084,364 | 4/1978 | Jones | 52/506.07 |
| 4,426,822 | 6/1984 | Gailey . | |
| 4,438,613 | 3/1984 | Hintsa et al. . | |
| 4,545,166 | 10/1985 | Kielmeyer . | |
| 4,569,175 | 2/1986 | Abciuk . | |
| 4,663,911 | 5/1987 | Gracia . | |
| 4,665,674 | 5/1987 | Brugman . | |
| 4,827,687 | 5/1989 | Frawley . | |
| 5,203,818 | 4/1993 | Kuiper . | |

FOREIGN PATENT DOCUMENTS

| | | | |
|---|---|---|---|
| 37517 | 10/1981 | European Pat. Off. | 52/506.06 |
| 306463 | 3/1989 | European Pat. Off. | 52/506.06 |
| 1399549 | 4/1965 | France | 52/506.06 |
| 2728912 | 1/1979 | Germany | 52/506.06 |

*Primary Examiner*—Ramon O. Ramirez
*Assistant Examiner*—Derek J. Berger
*Attorney, Agent, or Firm*—Harness, Dickey & Pierce

[57] ABSTRACT

A suspended horizontal ceiling system includes an upper support member vertically below a built ceiling, a suspension member to support a ceiling panel below the support member, and a support arrangement for providing vertical adjustment to the panels of such ceiling system. The support arrangement includes a spring clamp fixedly mounted to the support member, and an axial support rod connected to the suspension member. The clamp includes a positioning lip to assure proper and rapid placement of the clamp to the support member and a pair of resilient cantilevered plate sections which extend from the plate and away from one another to grip the outer periphery of the support rod whereby to prevent vertical movement of the support rod and deflect towards one another to release and permit vertical movement of the support rod.

18 Claims, 2 Drawing Sheets

ADJUSTABLE HANGER FOR SUSPENDED CEILINGS

BACKGROUND OF THE INVENTION

The invention relates to suspended horizontal ceiling systems, and more particularly to a mounting arrangement for suspending and effecting vertical adjustment of the grid members of such ceiling system.

Suspended ceilings are widely used in interior constructions for decorative purposes or to improve acoustics in a room of a building, or in order to place electrical wiring, air conditioning ducts or the like between the built ceiling of the room and the suspended ceiling. Typically the suspended ceiling comprises an assembly of panels extending horizontally in spaced parallel relation to one another with their major surfaces lying in horizontal planes spaced below the true or structural ceiling of a room, and removably carried by horizontal stringers or like members which are themselves suspended from the true ceiling by vertically adjustable suspension devices.

The use of a spring clip to suspend the stringers has been used and offers the advantage of being inexpensive while allowing for vertical adjustability. However, there is always need for an improved apparatus for mounting and vertically positioning the panels of a ceiling.

SUMMARY OF THE INVENTION

This invention seeks to eliminate the aforementioned drawbacks by a suspension device constructed with a minimum of component parts, which offers quick assembly, vertical positioning and adjustment of the panels.

According to this invention there is provided a support structure for concealed suspension of latticework ceilings, comprising an upper support member mounted vertically below a built ceiling, a lower suspension member to support a ceiling panel below the support member, and a support arrangement for joining the members together. The support arrangement comprises a spring clamp and an axially elongated support rod arranged vertically. The clamp includes a base plate which is fixedly mounted to the upper support member and a pair of resilient plate sections which form a V-shaped profile. The support rod has an upper end portion which is connected to the plate sections and a lower J-shaped end portion or other configuration to ease assembly connected to the lower suspension member.

The flange sections are connected to the base plate as cantilever beams and each has an end portion which is free to deflect relative to the base plate and between first and second positions, each end portion being provided with an aperture. In the first position, the apertures are not in complete alignment and the flanges are adapted to engage the exterior of the support rod and inhibit vertical movement of the support rod. In the second position, the flanges are deflected towards one another and the apertures are in substantial alignment whereby to release the rod for vertical movement.

In operation, the ceiling system is installed and the panels adjusted relative to the built ceiling by fixedly mounting the clamps along the length of the upper support members. The flange sections of the respective clamps are forced towards one another to vertically align the apertures with one another. The upper end portions of the respective support rods are inserted through respective pairs of apertures, and the flange sections released thus causing the flange sections to grip the support rod. The lower formed end portions of the support rods are "hooked into" a slot in the lower suspension member. The formed ends are then crimped over the lower suspension member thus suspending the suspension member below the support member. Following such assembly, to the extent that the grid formed by the lower suspension members does not form a generally horizontally disposed plane, the support rods are selectively vertically adjusted.

BRIEF DESCRIPTION OF THE DRAWINGS

In order that the present invention may more readily be understood, the following description is given, merely by way of example, reference being made to the accompanying drawings in which.

DETAILED DESCRIPTION OF THE PREFERRED EMBODIMENT

Figure 1:
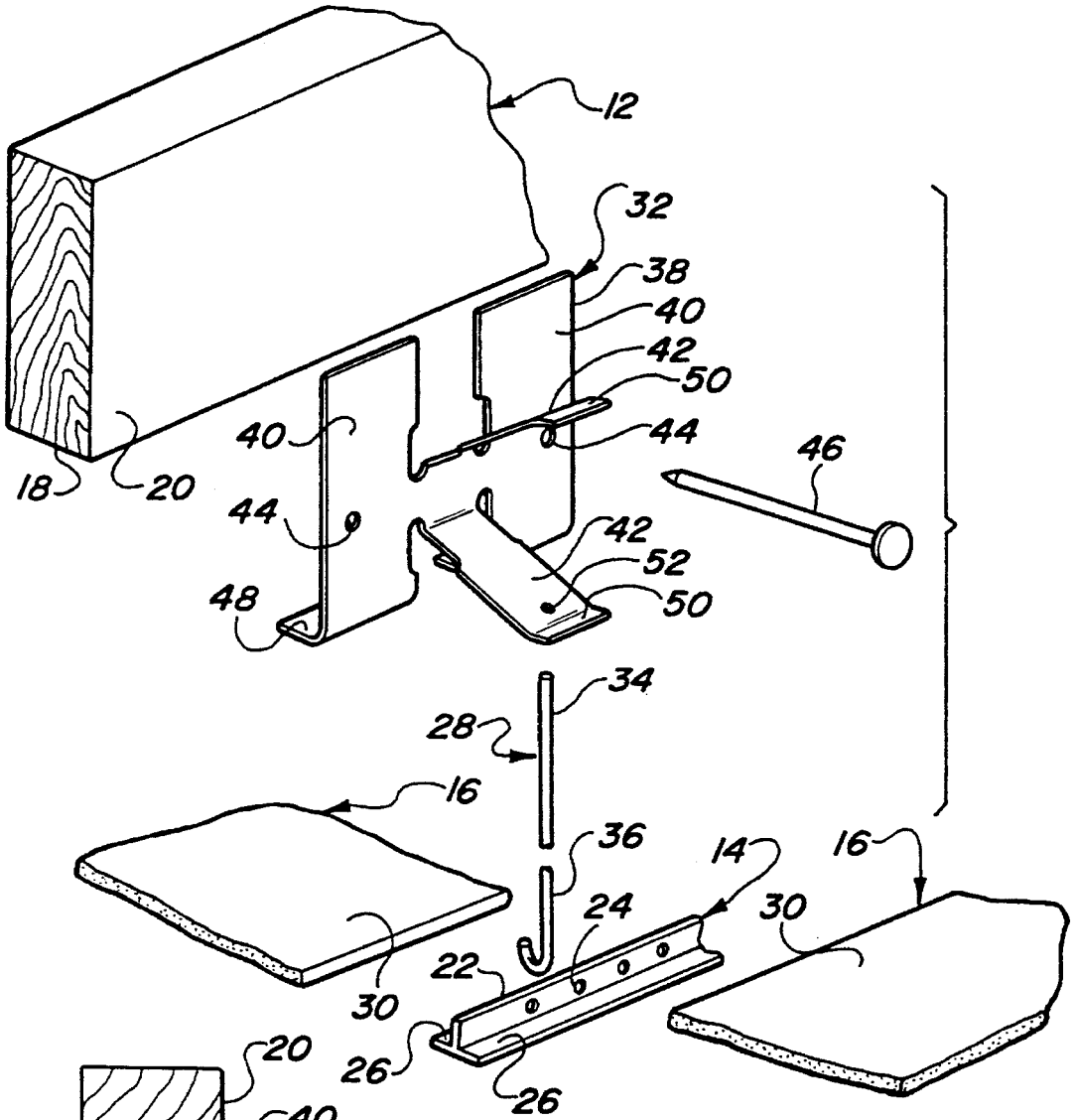
FIG. 1 is an exploded partial perspective view, in elevation, of a suspended ceiling assembly embodying the present invention.
Figure 2:
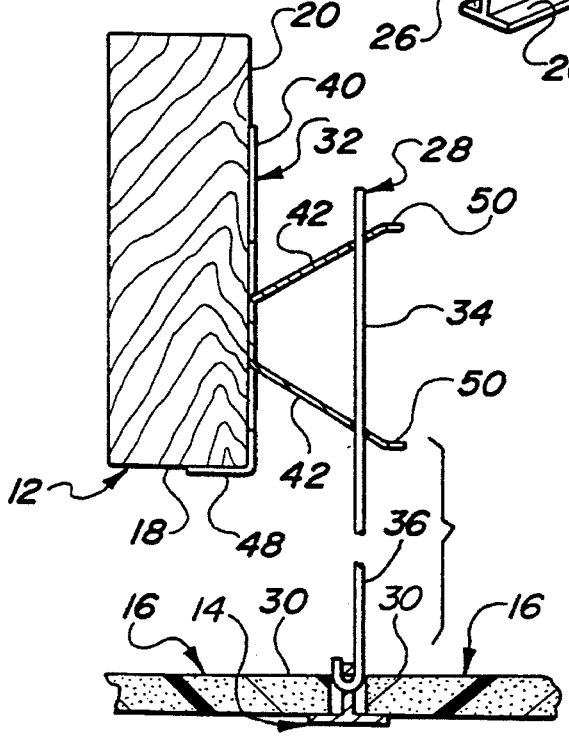
FIG. 2 is a cross-section view, in elevation, of the ceiling assembly of FIG. 1 shown secured to a support member.
Figure 3:
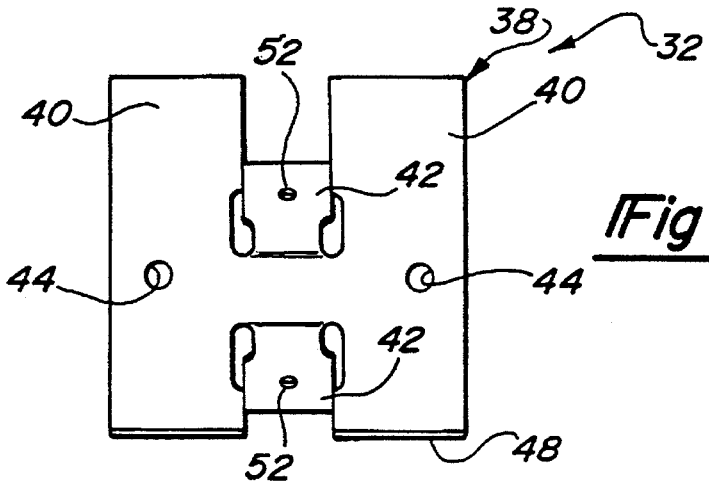
FIG. 3 is a bottom plan view of a spring clamp shown in FIG. 1.

Turning now to the drawings, a grid or latticework ceiling is shown as comprising a set of support members 12 adapted to connect to a built ceiling 10 of a building or other superjacent structure, a set of suspension members 14 for supporting a ceiling panel 16, and a support arrangement for joining the suspension members 14 to the support members 12. As shown, the support member 12 is preferably an elongated wooden joist of rectangular cross-section and having a bottom face 18 arranged horizontally and a pair of lateral faces 20 arranged vertically.

The suspension member 14 is a commercially available stringer or carrier, typically having a hat-shaped or T-profile cross-section extending longitudinally. In the embodiment shown, the suspension member 14 has the T-profile cross-section and includes a flange 22 arranged vertically and provided with a series of slots 24 at spaced intervals along its length and a pair of support webs 26 arranged horizontally, the slots operating to receive a support rod 28 to connect the suspension member 14 to the support member 12 and the support webs serving to support an edge 30 of a ceiling panel 16.

According to this invention, the arrangement for suspending the suspension members 14 below the support members 12 includes a set of support rods 28 and an associated set of spring clamps 32. Preferably, the support rod 28 is formed from an axially elongated wire and has an upper end portion 34 which is connected to the spring clamp 32 and a lower end portion 36 which is formed into an end formation hook that is received in one of the slots 24. Preferably, the cross-section of the support rod 28 is generally circular to facilitate horizontal adjustment.

In the exemplary embodiment, the spring clamp 32 is stamped and formed from a single sheet of metal or integrally formed from a suitable polymeric material. According to this invention, a preferred material is martensitic steel. However, it is to be understood that the spring clamp 32 can be other than integrally formed or can be manufactured from other suitable materials.

The clamp 32 includes a generally flat H-shaped base plate 38 having a pair of plate portions 40 and a pair of resiliently deflectable arms or cantilevered flange sections 42. The plate portions or other appropriate attachment include a mounting hole 44 sized to receive a fastening member 46 and are fixedly mounted to one of the lateral faces 20 of the support member 12 by the fastening members. Although the fastening member 46 is illustrated as comprising a nail, a threaded screw, rivet, lanced tab or integral rosettes would be suitable.

Importantly, the base plate 38 is provided with an inturned lip 48 which seats against the bottom face 18 of a support member 12. The lip 48 allows the user to rapidly position and secure a large number of spring clamps 32 during an installation.

The flange sections 42 are integral with the base plate 38, each flange section having an end portion 50 adapted to flex relative to the base plate. Generally, each flange section 42 is disposed at an angle of about 60° to the base plate whereby to form a C- or V-shaped profile. Further, the end portion 50 of each flange section 42 is provided with a generally circular aperture 52 to receive and pass the support rod 28 and is bent to form an engagement tab.

In operation, a set of spring clamps 32 are secured to their respective support members 12. The spring clamp would first be positioned against the support member 12 by abutting the inturned lip 48 against the bottom face 18 and the base plate 38 against the lateral face 20. The spring clamp is then fixedly secured to the support member 12 by its own internal device or by driving the fastening members 46 through the mounting holes 44 and into the support member, The flange sections 42 would be vertically superposed with one another and the centers of the apertures 52 arranged on a vertical axis.

The installer would then manually squeeze the two engagement tabs 50 and force the two flange sections 42 towards one another. By squeezing the engagement tabs 50 towards one another, the flange sections 42 are deflected towards one another and the apertures 52 are brought into substantial vertical alignment with one another. Thereupon, the upper end portion 34 of the support rod 28 is inserted through the apertures 52 in the two flange sections 42 and positioned relative to the clamp 32 and the lower end portion 36 formed with the required end form is positioned vertically therebelow, as required. The engagement tabs 50 are then released. Upon release, the flange sections 42 spring back towards their original position whereupon the edge portions of the plate section forming the respective apertures 52 are biased against and bitingly grip against the outer periphery of the support rod 28 thus to lock the support rod in place. The slot 24 of the suspension member 14 is then connected to the hook portion thus to suspend the suspension member below the support member 12. This step is repeated whereby a latticework grid of suspension members 14 form with their webs 26 a generally horizontal plane vertically below the built ceiling. The ceiling panels 16 are then supported on the webs of the grid or latticework thus formed.

Should the user need to adjust the vertical position of the ceiling formed by the suspension members 14, the flange sections 42 of one or more of the appropriate spring clamps would be pressed together, thus releasing the support rods, and the support rods 28 would be moved vertically, as desired.

Figure 4:
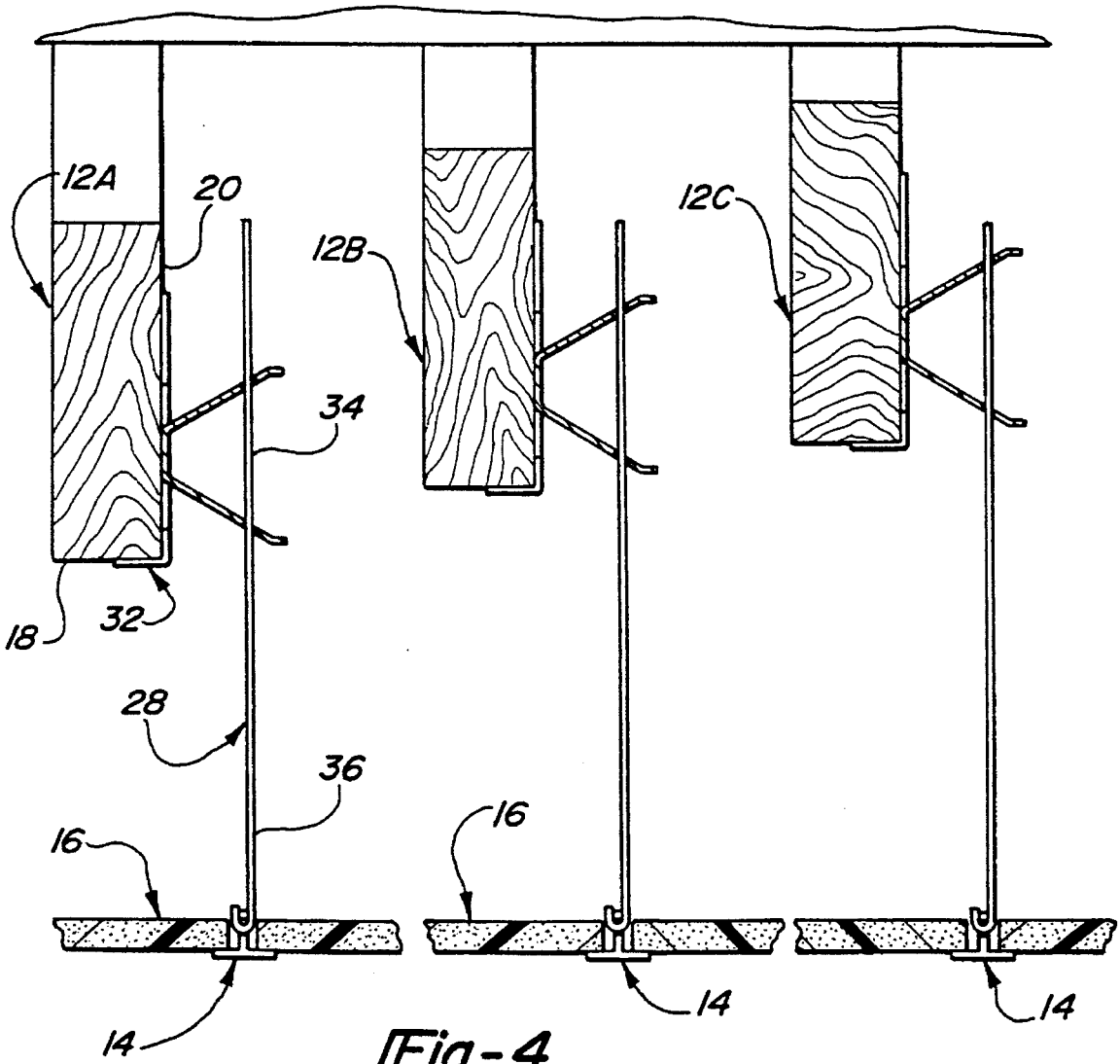
FIG. 4 is a cross-section view, in elevation, of a suspended ceiling system.

As shown in FIG. 4, the support members 12A, 12B and 12C are unequally spaced from the built ceiling 10. The support rods 28 allow rapid vertical adjustment of the suspension channels 14 relative to the spring clamps 32 whereby to form a horizontal latticework grid to receive the panels which form a false or decorative ceiling.

It will be appreciated that the structure of the present invention is very easy to mount and is of simple and inexpensive construction, and furthermore enables the user to rapidly position each positioning clamp.

What is claimed is:

1. A set for use with a decorative false ceiling, said false ceiling including a support member superjacent a built ceiling, and a suspension member having at least one web disposed horizontally for carrying a panel of the false ceiling and a flange disposed vertically, the set comprising:

an axially elongated support rod having a lower portion which is connectable to the flange and an upper portion;

a clamp having an H-shaped plate which is connectable to the support member and includes a pair of vertical plate portions and a transverse plate portion, said clamp further having a pair of resilient spring flanges having first and second end portions, said first and second end portions being connected to said plate, extending from said transverse plate portion and resiliently deflectable between a first position for gripping the upper end portion of the support rod a second position for releasing the support rod, each said spring flange having an aperture for receiving and gripping said support rod, said clamp being integrally formed from a resilient metal and including a lip extending transversely of said plate for positioning the clamp relative to said support member; and means associated with said vertical portions of the H-shaped plate for securing said plate to said support member.

2. A support structure for concealed suspension of a lattice ceiling comprising:

a first suspension member mounted vertically below an unfinished built ceiling, said first suspension member comprising a wood joist of generally rectangular cross-section and including a lateral face arranged vertically and a bottom face arranged horizontally;

a second suspension member to support a ceiling panel below said first suspension member; and support means for joining said suspension members together, said support means comprising a clamp adapted to fixedly connect to said first suspension member, said clamp having an H-shaped plate with a pair of vertical plate portions and a transverse portion, and a pair of resilient flange sections, said support means further including support rod adapted to removably connect to said second suspension member, each said flange section having a first end portion connected to said clamp and a second end portion to connect with the support rod, the second end portions being free to deflect relative to the clamp and towards and away from one another and be biased into gripping engagement against the exterior of the support rod thereby to inhibit vertical movement of said support rod relative to said clamp.

3. The support structure as claimed in claim 2, wherein said clamp is integrally formed from a resilient metal.

4. The support structure as claimed in claim 3 wherein said clamp comprises a base plate which is mounted to said lateral face, and positioning means for positioning the base plate relative to the lateral face.

5. The support structure as claimed in claim 4 wherein said support rod is axially elongated, and the second end portions of said flange sections each being provided with an aperture to receive the support rod.

6. The support structure as claimed in claim 5 wherein said clamp further comprises means for attaching said base plate to said lateral face.

7. The support structure as claimed in claim 5 wherein said flange sections are disposed at an acute angle to said base plate.

8. The support structure as claimed in claim 7 wherein said acute angle is about 60°.

9. The support structure as claimed in claim 7 wherein said second -suspension member comprises an elongated stringer having a T-shaped cross-section and including a slotted flange disposed vertically, and said support rod includes a J-shaped end portion to fit within a slot of said stringer.

10. A support for suspending a set of channel sections in horizontal relation below a set of support members fixedly disposed superjacent a built ceiling, said support comprising:

at least one spring clamp; and at least one support rod removably connectable to one of said channel sections;

said at least one spring clamp comprising an H-shaped plate which is fixedly securable at a desired location to one of said support members, a pair of resilient flanges which are cantilevered from said plate and adapted to be arranged in vertically superposed relation when the clamp is secured to said support member, each said flange having a first end only that is fixed to the plate and a second end that is free to flex in opposite directions relative to the plate and normally biased into a first position, and rod engagement means associated with said flanges for engaging and preventing said support rod from vertical movement when the flanges are in said first position and for disengaging and releasing said support rod for movement when the flanges are deflected to a second position.

11. The support as claimed in claim 10, wherein said H-shaped plate includes a pair of vertical plate portions interconnected by a transverse plate portion, said pair of resilient flanges extending from said transverse plate portion.

12. The support as claimed in claim 11 and comprising a like plurality of spring clamps and associated support rods.

13. The support as claimed in claim 12 wherein said spring clamps include positioning means for vertically positioning said flanges relative to said support member.

14. The support as claimed in claim 11 wherein said rod engagement means comprises the second end portion of each said flange having an aperture to receive and to pass the support rod, said apertures being slightly greater in cross-section than the cross-section of the support rod, and said apertures each having a first apparent minor diameter in a horizontal plane when the flanges are in said first position, said first apparent minor diameter being less than the cross-section of the support rod, whereby the flanges engage and inhibit vertical movement of the rod and said aperture each having a second apparent minor diameter in a horizontal plane when the flanges are in said second position, said second apparent minor diameter being greater than the cross-section of the support rod, whereby to release the support rod.

15. A set, for use with a decorative false ceiling, said false ceiling including a support member superjacent a built ceiling, and a suspension member having at least one web disposed horizontally for carrying a panel of the false ceiling and a flange disposed vertically, the set comprising:

an axially elongated support rod having a lower portion which is connectable to the flange and an upper portion; and a clamp integrally formed from a resilient metal and having an H-shaped plate which is connectable to the support member and a pair of resilient spring flanges having first and second end portions, said plate including a pair of vertical plate portions and a transverse plate portion interdisposed therebetween, said first end portions being connected to said transverse plate portion and said second end portions extending from said plate in opposite directions and into a first position for gripping the upper end portion of the support rod, said second end portions being resiliently deflectable towards one another and into a second position for releasing the support rod.

16. The set as claimed in claim 15 wherein each said spring flange has an aperture for receiving and gripping the support rod.

17. The set as claimed in claim 16 wherein said clamp is integrally formed and includes a lip extending transversely of said plate for positioning the clamp relative to said support member.

18. The set as claimed in claim 17 wherein each said spring flange is disposed at an acute angle to said plate.

* * * * *